US007094038B2

(12) United States Patent
Choi

(10) Patent No.: US 7,094,038 B2
(45) **Date of Patent: *Aug. 22, 2006**

(54) VACUUM PREVENTING DEVICE FOR SCROLL COMPRESSOR

(75) Inventor: Song Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 214 days.

This patent is subject to a terminal disclaimer.

(21) Appl. No.: 10/394,258

(22) Filed: Mar. 24, 2003

(65) Prior Publication Data

US 2003/0202886 A1 Oct. 30, 2003

(30) Foreign Application Priority Data

Apr. 29, 2002 (KR) ..... 10-2002-0023474

(51) Int. Cl.
*F04B 49/00* (2006.01)
*F01C 1/063* (2006.01)

(52) U.S. Cl. ..... 417/310; 417/410.5; 418/55.1

(58) Field of Classification Search ..... 417/410.5, 417/310; 418/55.1
See application file for complete search history.

(56) References Cited

U.S. PATENT DOCUMENTS

| | | | | |
|---|---|---|---|---|
| 4,642,034 | A * | 2/1987 | Terauchi | 417/295 |
| 5,342,183 | A * | 8/1994 | Rafalovich et al. | 418/15 |
| 6,176,685 | B1 * | 1/2001 | Iizuka et al. | 417/310 |
| 6,190,138 | B1 * | 2/2001 | Hugenroth et al. | 417/310 |
| 6,893,229 | B1 * | 5/2005 | Choi et al. | 417/310 |

FOREIGN PATENT DOCUMENTS

JP 0-356194 12/2000

* cited by examiner

*Primary Examiner*—Charles Freay
(74) *Attorney, Agent, or Firm*—Greenblum & Bernstein,

(57) ABSTRACT

Disclosed is a vacuum preventing device including a housing engaged to one side of an outer circumference portion of a fixed scroll to divide the area into a discharge region and a suction region, a chamber formed in the housing and having a compression hole connected to a compression region at one side therein, a suction hole connected to a suction region at the other side therein, and a discharge hole connected to a discharge region at a middle side therein, an open/close member is movably installed in the chamber to selectively connect the discharge hole to the suction hole, and an elastic member is installed in the chamber to provide an elasticity force to the open/close member.

20 Claims, 5 Drawing Sheets

VACUUM PREVENTING DEVICE FOR SCROLL COMPRESSOR

RELATED APPLICATIONS

The present disclosure relates to subject matter contained in priority Korean Application 2002-0023474, filed on Apr. 29, 2002.

BACKGROUND OF THE INVENTION

1. Field of the Invention

The present invention relates to a scroll compressor, and more particularly, to a vacuum preventing device for a scroll compressor in which gas in a discharge region flows backward to a suction region at the time of an abnormal driving such as when pump is down or when an expansion valve is blocked, thereby preventing a vacuum of the compressor.

2. Description of the Background Art

Generally, a compressor is a device for converting mechanical energy into latent energy of a compression fluid. Generally they can be classified as a reciprocation compressor, a scroll compressor, a centrifugal compressor, and a vane compressor based upon the compression method.

The scroll compressor has a structure such that gas is taken-in, compressed, and discharged by using a rotation member, such as the centrifugal type and the vane type, differently from the reciprocating type which uses a linear reciprocation of an open/close member.

FIG. 1 is a longitudinal sectional view showing an inner part of the conventional scroll compressor.

As shown, the scroll compressor comprises: a case 1 divided into a gas suction tube SP and a gas discharge tube DP; a main frame 2 and a sub frame (not shown) respectively installed at both upper and lower portions of an inner circumference surface of the case 1; a driving motor 3 installed between the main frame 2 and the sub frame; a rotation shaft 4 engaged with a center portion of the driving motor 3 for transmitting a rotation force of the driving motor 3; an orbiting scroll 5 installed to have an eccentric rotation at an upper portion of the rotation shaft 4 and having a wrap 5*a* of an involute curve shape at the upper portion thereof; and a fixed scroll 6 fixed to an upper portion of the main frame 2, engaged to the orbiting scroll 5, and having a wrap 6*a* of an involute curve shape so as to form a plurality of compression spaces P therein.

The case 1 is divided into a suction region S1 and a discharge region S2 by a high and low pressure separation plate 7, and a compression region S3 is formed at a position connected to the compression space P.

A gas inlet 6*b* and an outlet 6*c* are respectively formed at a lateral surface and a center portion of the fixed scroll 6, and a non-return valve 8 for preventing discharged gas from flowing backward is installed at an upper surface of the fixed scroll 6.

The main frame 2 and the sub frame are fixed to the inner circumference surface of the case 1 by a fixation means such as welding, and the fixed scroll 6 is also fixed to a bottom surface of the high and low pressure separation plate 7 by a fixation means such as a bolt.

Meantime, in case that a pump is down and an expansion valve blockage, the suction region S1 of the compressor becomes a high vacuum state. As a result, components of the compressor may be damaged and destroyed.

To prevent this problem, a vacuum preventing device 20 is provided in the conventional art.

FIG. 2 is a longitudinal sectional view showing an operation during normal driving, of the vacuum preventing device of FIG. 1, and FIG. 3 is a longitudinal sectional view showing an operation during abnormal driving of the vacuum preventing device of FIG. 1.

Referring to FIGS. 2 and 3, the vacuum preventing device 20 includes a chamber 10 formed at one side of the fixed scroll 6, and a discharge hole 11 connected to the discharge region S2 at an upper surface of the chamber 10.

A compression hole 12 connected to the compression region S3 is formed at a bottom surface of the chamber 10, a plug 14 having a suction hole 13 is fixed to an opening portion of the chamber 10 by a fixation pin 15, and the suction hole 13 is connected to the discharge hole 11.

An open/close member 17 for selectively connecting the discharge hole 11 and the suction hole 13 is movably installed in the chamber 10.

A spring 16 for limiting a movement of the open/close member 17 and providing an elasticity force thereto is installed at the opening portion of the chamber 10.

Hereinafter, operations of the conventional scroll compressor will be explained.

First, when a power source is applied to the driving motor 3, the driving motor 3 rotates the rotation shaft 4, and the orbiting scroll 5 engaged to the rotation shaft 4 is rotated to an extent of its eccentric distance.

At this time, a plurality of compression spaces P formed between the wrap 5*a* of the orbiting scroll 5 and the wrap 6*a* of the fixed scroll 6 gradually move towards a center portion of the fixed scroll 6 as the orbiting scroll 5 continuously performs an orbiting movement, thereby causing a decreased volume.

By the decreased volume of the compression spaces P, gas of the suction region S2 is taken into the compression space P through the inlet 6*b*, and the taken gas is discharged to the discharge region S2 through the outlet 6*c*.

When the compressor is normally driven (FIG. 2), a pressure of the compression region is larger than an elasticity force of the spring 16, so that the open/close member 17 overcomes the elasticity force of the spring 16 and shields (i.e., abstracts) the discharge hole 11.

However, when the compressor is abnormally driven (FIG. 3), a pressure of the compression region is smaller than the elasticity force of the spring 16, so that the open/close member 17 is moved by the elasticity force of the spring 16 and opens the discharge hole 11. At this time, the discharge hole 11 is connected to the suction hole 13.

As the discharge hole 11 and the suction hole 13 are connected to each other, gas of the discharge region S2 flows backward into the suction region S1 through the discharge hole 11 and the suction hole 13, thereby releasing a vacuum of the compressor.

Moreover, in the conventional art, since the vacuum preventing device is formed in the fixed scroll, a fabrication cost is expensive and a strength of the fixed scroll is degraded, thereby easily destroying the fixed scroll at the time of an operation.

SUMMARY OF THE INVENTION

Therefore, an object of the present invention is to provide a vacuum preventing device for a scroll compressor in which a vacuum preventing structure is installed at an outer portion of a fixed scroll to reduce a fabricating cost of the fixed scroll and to enhance a strength of the fixed scroll, and thereby to efficiently prevent a destruction thereof.

To achieve these and other advantages and in accordance with the purpose of the present invention, as embodied and broadly described herein, there is provided a vacuum preventing device for a scroll compressor comprising: a housing engaged to one side of an outer circumference portion of a fixed scroll to divide into a discharge region and a suction region; a chamber formed in the housing and having a compression hole connected to a compression region at one side therein, a suction hole connected to a suction region at the other side therein, and a discharge hole connected to a discharge region at a middle side therein; an open/close member movably installed in the chamber to selectively connect the discharge hole to the suction hole; and an elastic member installed in the chamber to provide an elasticity force to the open/close member.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, the vacuum preventing device for a scroll compressor according to the present invention will be explained with reference to attached drawings.

Figure 4:
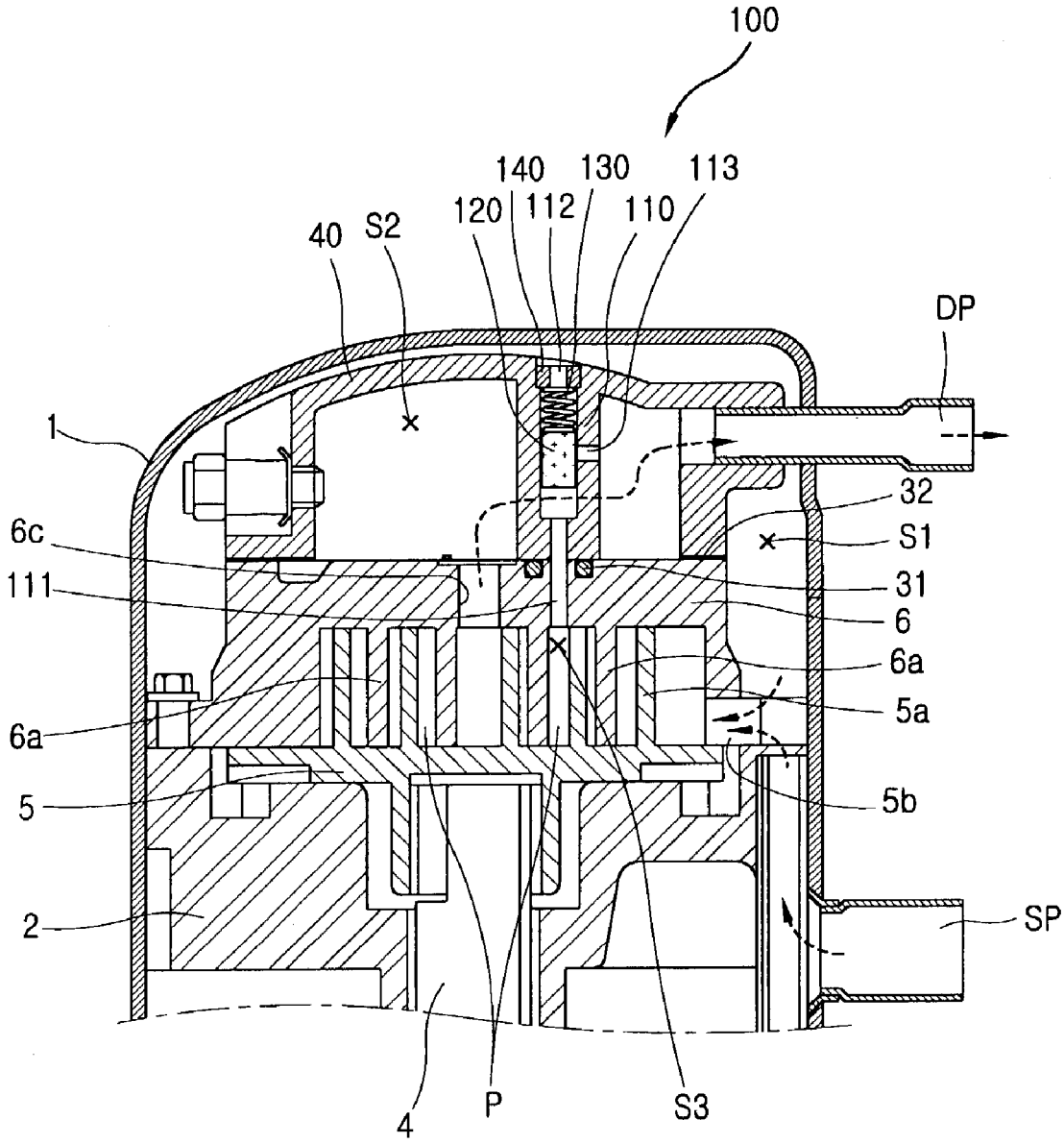
FIG. 4 is a longitudinal sectional view showing a scroll compressor according to the present invention.
Figure 5:
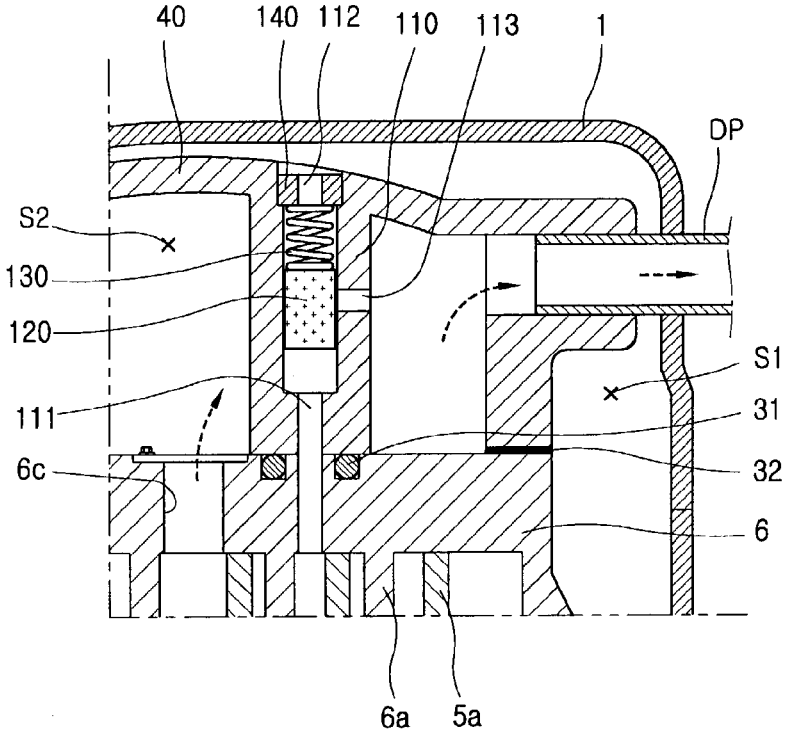
FIG. 5 is a longitudinal sectional view showing an operation of the vacuum preventing device when the compressor of FIG. 4 is normally driven.
Figure 6:
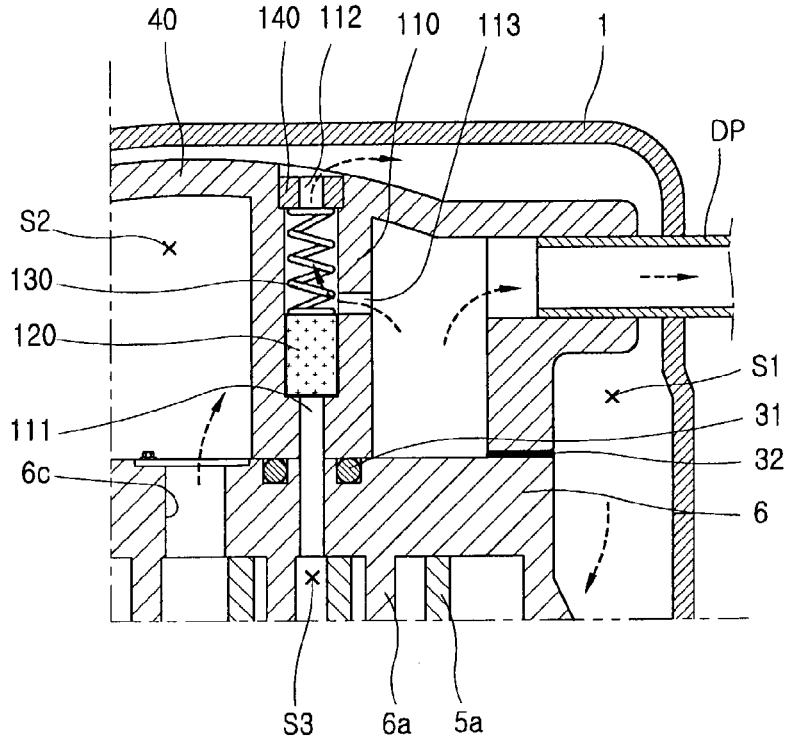
FIG. 6 is a longitudinal sectional view showing an operation of the vacuum preventing device when the compressor of FIG. 4 is abnormally driven.

FIG. 4 is a longitudinal sectional view showing a scroll compressor according to the present invention, FIG. 5 is a longitudinal sectional view showing an operation of the vacuum preventing device when the compressor of FIG. 4 is normally driven, and FIG. 6 is a longitudinal sectional view showing an operation of the vacuum preventing device when the compressor of FIG. 4 is abnormally driven.

As shown, the scroll compressor according to the present invention comprises: a fixed scroll 6 installed in a case 1 divided into a suction region S1 for taking-in a gas and a compression region S3 for compressing the gas; an orbiting scroll 5 engaged to the fixed scroll 6 to form a compression space P connected to the compression region therein and engaged to a shaft 4 of a driving motor 3 in the case 1 to with an eccentric rotation for taking-in, compressing, and discharging gas; and a vacuum preventing device 100 installed at one side of the fixed scroll 6.

The vacuum preventing device 100 for a scroll compressor according to the present invention comprises: a housing 40 engaged (i.e., secured) to one side of an outer circumferential portion of a fixed scroll 6 to define a discharge region and a suction region therein; a chamber 110 formed in the housing 40 and having a compression hole 111 connected to a compression region S3 at one side therein, a suction hole 112 connected to a suction region S1 at the other side therein, and a discharge hole 113 connected to a discharge region S2 at a middle side therein; an open/close member 120 movably installed in the chamber 110 for selectively connecting the discharge hole 113 to the suction hole 112; and an elastic member 130 installed in the chamber 110 for providing an elasticity force to the open/close member 120.

The housing 40 is engaged to an upper surface of the outer circumferential portion of the fixed scroll 6 to divide the area into a discharge region S2 and a suction region S1 and also reduces noise by acting as a muffler.

Also, the discharge region S2 formed in the housing 40 is connected to a discharge pipe DP and the suction region S1 formed at an outer portion of the housing 40 is connected to a suction pipe SP.

The chamber 110 formed in the housing 40 has two end portions respectively connected to the suction region S1 and the compression region S3.

That is, the chamber 110 is provided with a compression hole 111 connected to the compression region S3 at the lower portion thereof, a suction hole 112 connected to the suction region S1 at the upper portion thereof, and a discharge hole 113 connected to the discharge region S2 at the middle portion thereof.

A seal member 32 is preferably installed at a contact portion between the housing 40 and the fixed scroll 6 so as to prevent gas leakage from the compression region S3. A seal member 31 is also installed at a contact portion between the chamber 110 and the fixed scroll 6.

An O ring 31 or a gasket can be used for the seal member.

The housing 40 and the chamber 110 are fabricated by a general or usual method such as a die casting, and the housing 40 and the chamber 110 are fixed to an upper surface of the fixed scroll 6.

The open/close member 120 is movably installed in the chamber 110 so as to selectively connect the discharge hole 113 to the suction hole 112.

An elasticity coefficient of the elastic member 130 has to be properly set so that the open/close member 120 can overcome the elasticity force of the elastic member 130 by a pressure exerted through the compression hole 111, move, and close the suction hole 112 in a normal driving condition. With the properly set elasticity coefficient of the elastic member 130, the open/close member 120 moves to connect the discharge hole 113 to the suction hole 112 by the elasticity force of the elastic member 130 in an abnormal driving condition.

The elastic member 130 is installed in the chamber 110 and provides the elasticity force to the open/close member 120. Also, the plug 140 fixes the elastic member 130 into the chamber 110.

Hereinafter, operations and effects of the vacuum preventing device for a scroll compressor according to the present invention will be explained.

Figure 1:
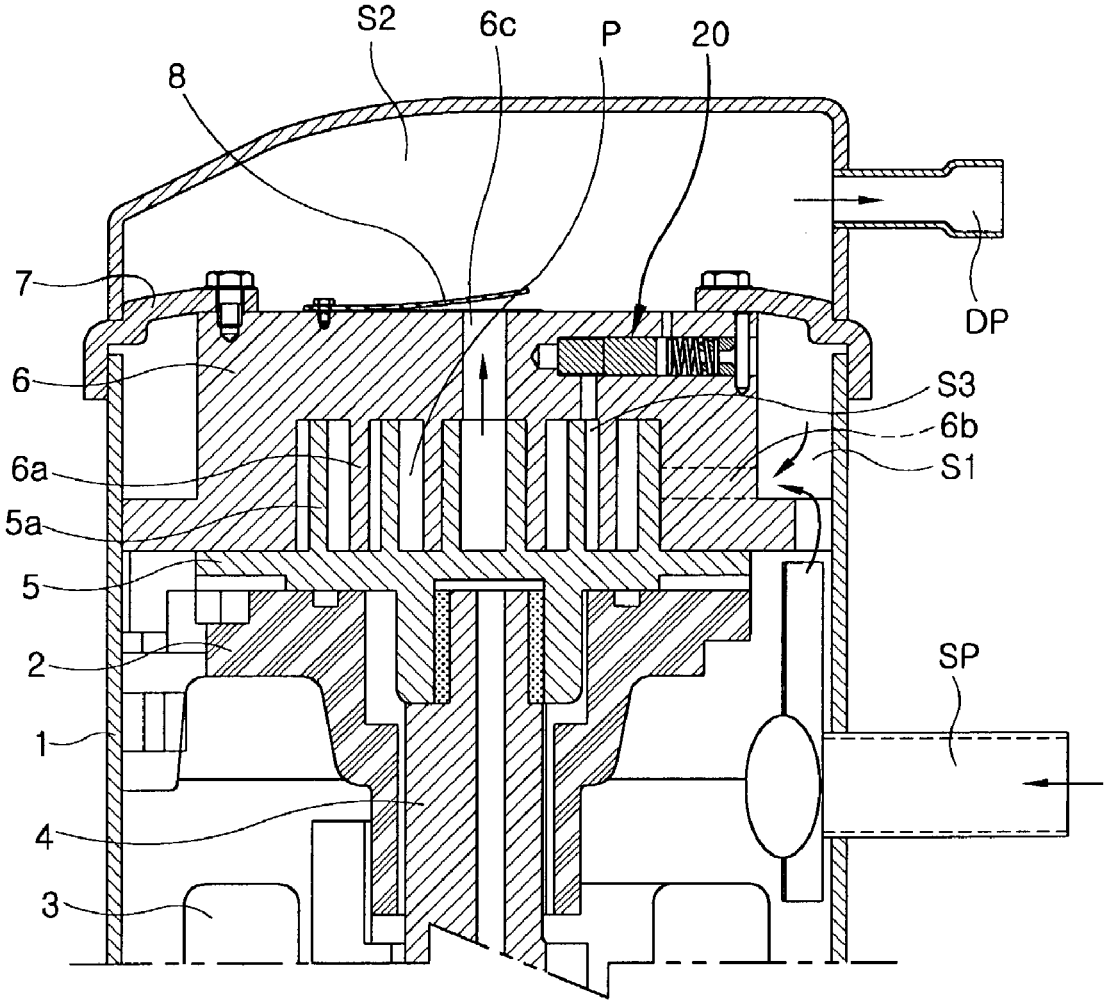
FIG. 1 CONVENTIONAL ART
FIG. 1 is a longitudinal sectional view showing a part of a conventional scroll compressor.
Figure 2:
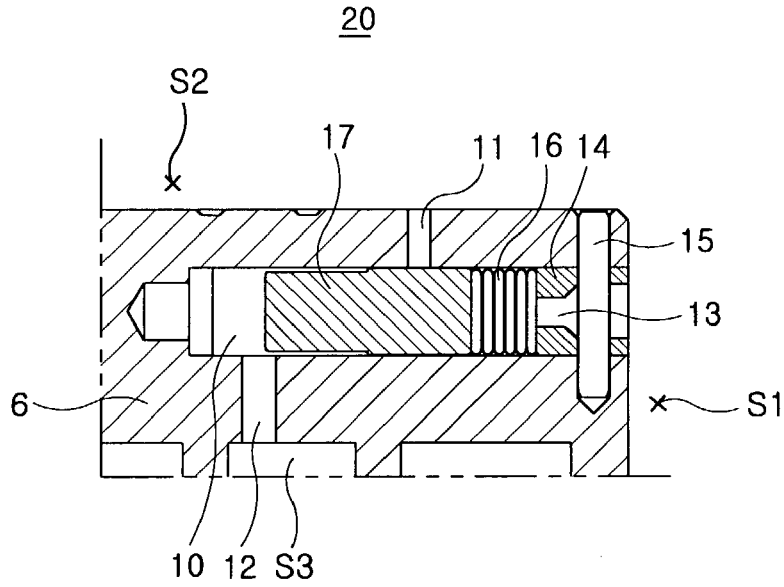
FIG. 2 CONVENTIONAL ART
FIG. 2 is a longitudinal sectional view showing an operation during normal driving, of the vacuum preventing device of FIG. 1.
Figure 3:
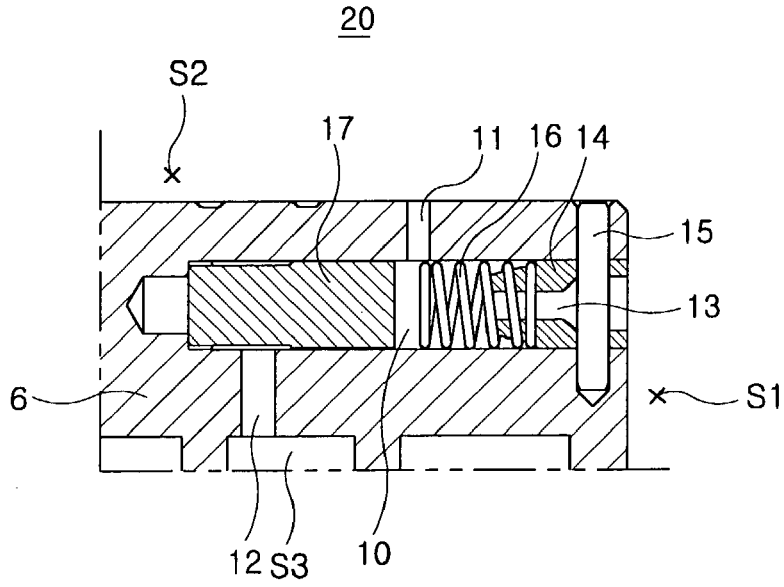
FIG. 3 CONVENTIONAL ART
FIG. 3 is a longitudinal sectional view showing an operation during abnormal driving, of the vacuum preventing device of FIG. 1.

As shown in FIG. 4, as the orbiting scroll 5 orbits by the driving motor 3 (referring to FIG. 1), gas of the suction region S1 is taken-in, compressed in the compression space P, and discharged to the discharge region S2.

As shown in FIG. 5, when the compressor is normally driven, pressure gas is introduced into the chamber 110 through the compression hole 111, and pushes up the open/close member 120.

At this time, the open/close member 120 closes the discharge hole 113, so that discharged gas in the discharge region S2 of the housing 40 can not flow back to the suction region S1 through the discharge hole 113.

On the contrary, as shown in FIG. 6, when the compressor is abnormally driven, a pressure of the compression region S3 is smaller than the elasticity force of the spring 130, so that the open/close member 120 is pushed by the elasticity force of the elastic member 130 and opens the discharge hole 113. At this time, the discharge hole 113 is connected to the suction hole 112.

As the discharge hole 113 and the suction hole 112 are connected to each other, gas of the discharge region S2 flows backward into the suction region S1 through the discharge hole 113 and the suction hole 112, thereby releasing a vacuum of the compressor.

Subsequently, when the compressor is normally operated, compression gas of the compression chamber is introduced into the chamber 110 through the compression hole 111. At this time, the compression gas has to rapidly push up the open/close member 120 to minimize leakage of discharge gas.

Figure 7:
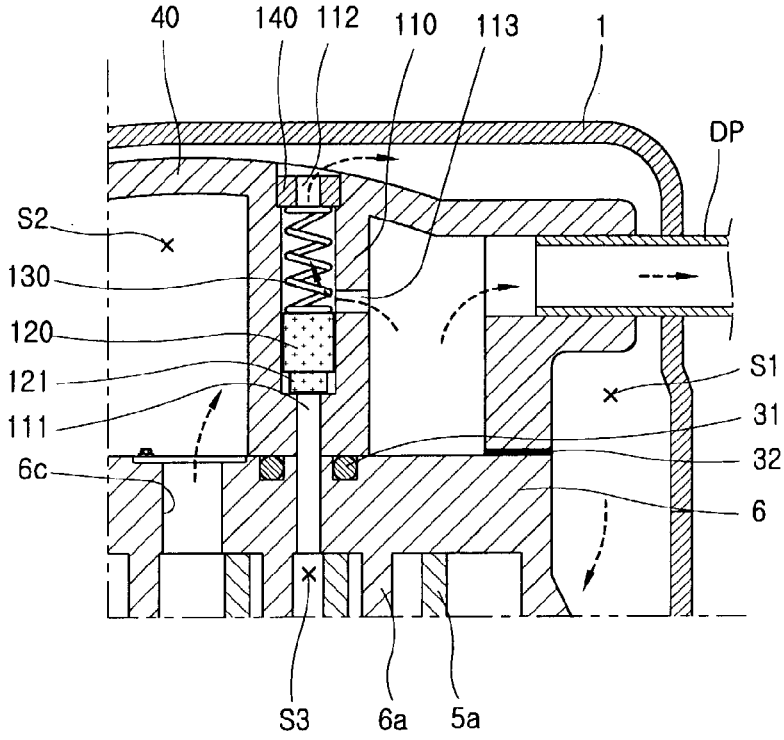
FIG. 7 is a longitudinal sectional view showing another preferred embodiment of the present invention.
Figure 8:
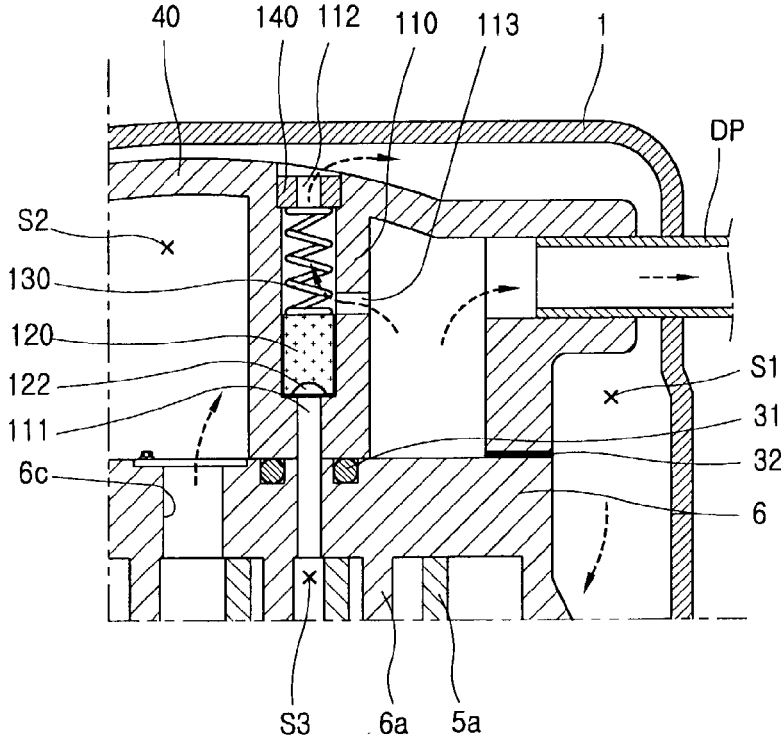
FIG. 8 is a longitudinal sectional view showing still another preferred embodiment of the present invention.

To this end, as shown in FIGS. 7 and 8, a protrusion or a recess is formed at the lower portion of the open/close member.

FIG. 7 is a longitudinal sectional view showing another preferred embodiment of the present invention.

As shown, a protrusion 121 is formed at the lower portion of the open/close member 120. When a sectional area of the lower portion of the open/close member which blocks the compression hole 111 becomes small, compression gas is rapidly introduced into the chamber 110 through the compression hole 111 and the open/close member 120 is rapidly pushed up.

Accordingly, as the open/close member 120 is rapidly pushed up by the compression gas, leakage of the discharge gas can be minimized.

It is preferable that a diameter of the protrusion 121 is formed within a range of an inner diameter of the chamber 110 and an inner diameter of the compression hole 111.

FIG. 8 is a longitudinal sectional view showing still another preferred embodiment of the present invention.

As shown, a recess 122 is formed at the lower portion of the open/close member 120. When a sectional area of the lower portion of the open/close member 120 which blocks the compression hole 111 becomes great, compression gas rapidly pushes up the open/close member 120 with a greater pressure through the compression hole 111.

Accordingly, as the open/close member 120 is rapidly pushed up by the compression gas, leakage of the discharge gas can be minimized.

As aforementioned, in the present invention, by installing the vacuum preventing device at an outer portion of the fixed scroll, additionally, a fabricating cost is reduced and a strength of the fixed scroll is maintained, thereby efficiently preventing a vacuum of the compressor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A vacuum preventing device for a scroll compressor comprising:

a housing engaged with one side of an outer circumferential portion of a fixed scroll to define a discharge region and a suction region;

a chamber formed in the housing and having a compression hole connected to a compression region at one side therein, a suction hole connected to a suction region at the other side therein, and a discharge hole connected to a discharge region at a middle side therein;

an open/close member movably installed in the chamber to selectively connect the discharge hole to the suction hole; and an elastic member installed in the chamber to provide an elasticity force to the open/close member, wherein in an abnormal driving condition, the open/close member is positioned to connect the discharge hole to the suction hole by the elasticity force of the elastic member being stronger than a pressure applied through the compression hole, and in a normal driving condition, the open/close member is positioned to obstruct the suction hole by a balance between the elasticity force of the elastic member and the pressure applied through the compression hole.

2. The device of claim 1, wherein the housing is located at an upper surface of the fixed scroll.

3. The device of claim 1, wherein a major dimension of the chamber extends perpendicularly from a surface of the fixed scroll.

4. The device of claim 1, wherein a plug is installed in the chamber so as to retain the elastic member.

5. The device of claim 1, wherein a seal member is installed at a contact portion between the chamber and the fixed scroll and at a contact portion between the housing and the fixed scroll.

6. The device of claim 1, wherein a normal driving condition, the open/close member is positioned to obstruction hole by a balance between an elasticity force of the elastic member and a pressure applied through the compression hole.

7. The device of claim 1, wherein a protrusion to close and to open the compression hole is formed at one side of the open/close member.

8. The device of claim 7, wherein in a diameter of the protrusion is within a range between an inner diameter of the chamber and an inner diameter of the compression hole.

9. A vacuum preventing device for a scroll compressor comprising:

a housing engaged with one side of an outer circumferential portion of a fixed scroll to define a discharge region and a suction region;

a chamber formed in the housing and having a compression hole connected to a compression region at one side therein, a suction hole connected to a suction region at the other side therein, and a discharge hole connected to a discharge region at a middle side therein;

an open/dose member movably installed in the chamber to selectively conned the discharge hole to the suction hole; and an elastic member installed in the chamber to provide an elasticity force to the open/close member, wherein a protrusion to close and open the compression hole is formed at one side of the open/close member.

10. The device of claim 9, wherein the housing is located at an upper surface of the fixed scroll.

11. The device of claim 9, wherein a major dimension of the chamber extends perpendicularly from a surface of the fixed scroll.

12. The device of claim 9, wherein a plug is installed in the chamber so as to retain the elastic member.

13. The device of claim 9, wherein a seal member is installed at a contact portion between the chamber and the fixed scroll and at a contact portion between the housing and the fixed scroll.

14. The device of claim 9, wherein in a normal driving condition, the open/dose member Is positioned to obstruct the suction hole by a balance between an elasticity force of the elastic member and a pressure applied through the compression hole.

15. The device of claim 9, wherein a diameter of the protrusion is within a range between an inner diameter of the chamber and an inner diameter of the compression hole.

16. A vacuum preventing device for a scroll compressor comprising:

a housing engaged with one side of an outer circumferential portion of a fixed scroll to define a discharge region and a suction region;

a chamber formed in the housing and having a compression hole connected to a compression region at one side therein, a suction hole connected to a suction region at the other side therein, and a discharge hole connected to a discharge region at a middle side therein;

an open/close member movably installed in the chamber to selectively connect the discharge hole to the suction hole; and an elastic member installed in the chamber to provide an elasticity force to the open/close member, wherein the open/close member moves in an opening direction of the compression hole and discharge hole, the elastic member is installed in an opening direction of the compression hole and discharge hole, and the elastic member is installed adjacent to the discharge hole.

17. The device of claim 16, wherein the housing is located at an upper surface of the fixed scroll.

18. The device of claim 16, wherein a major dimension of the chamber extends perpendicularly from a surface of the fixed scroll.

19. The device of claim 16, wherein a seal member is installed at a contact portion between the chamber and the fixed scroll and at a contact portion between the housing and the fixed scroll.

20. The device of claim 16, wherein in a normal driving condition, the open/close member is positioned to obstruct the suction hole by a balance between an elasticity force of the elastic member and a pressure applied through the compression hole.

* * * * *

UNITED STATES PATENT AND TRADEMARK OFFICE

CERTIFICATE OF CORRECTION

PATENT NO. : 7,094,038 B2
APPLICATION NO. : 10/394258
DATED : August 22, 2006
INVENTOR(S) : Choi It is certified that error appears in the above-identified patent and that said Letters Patent is hereby corrected as shown below:

At column 6, line 52 (claim 6, line 1), “wherein a” should be --wherein in a--.

At column 6, line 53 (claim 6, line 2), “obstruction hole” should be --obstruct the suction hole--.

At column 7, line 7 (claim 9, line 12), “conned” should be --connect--.

At column 7, line 25 (claim 14, line 2), “Is” should be --is--.

Signed and Sealed this

Eighteenth Day of December, 2007

JON W. DUDAS
*Director of the United States Patent and Trademark Office*